US008726867B2

(12) United States Patent
Niiro et al.

(10) Patent No.: US 8,726,867 B2
(45) Date of Patent: May 20, 2014

(54) PHASE VARYING APPARATUS FOR AUTOMOBILE ENGINE TECHNICAL

(75) Inventors: Masaaki Niiro, Hadano (JP); Michihiro Kameda, Hadano (JP); Koichi Homma, Hadano (JP); Masayasu Nagado, Hadano (JP)

(73) Assignee: Nittan Valve Co., Ltd., Kanagawa (JP)

( * ) Notice: Subject to any disclaimer, the term of this patent is extended or adjusted under 35 U.S.C. 154(b) by 0 days.

(21) Appl. No.: 13/879,274

(22) PCT Filed: Oct. 12, 2010

(86) PCT No.: PCT/JP2010/067859

§ 371 (c)(1),
(2), (4) Date: Apr. 12, 2013

(87) PCT Pub. No.: WO2012/049727

PCT Pub. Date: Apr. 19, 2012

(65) Prior Publication Data

US 2013/0192552 A1 Aug. 1, 2013

(51) Int. Cl.
*F01L 1/34* (2006.01)

(52) U.S. Cl.
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS

2011/0226202 A1* 9/2011 Nagado ..... 123/90.15

FOREIGN PATENT DOCUMENTS

| | | | |
|---|---|---|---|
| WO | 2009/130770 | A1 | 10/2009 |
| WO | 2010/026645 | A1 | 3/2010 |
| WO | 2010/046974 | A1 | 4/2010 |
| WO | 2010/113279 | A1 | 10/2010 |
| WO | 2011/145175 | A1 | 11/2011 |

OTHER PUBLICATIONS

International Search Report of PCT/JP2010/067859, Mailing Date of Nov. 30, 2010.

* cited by examiner

*Primary Examiner* — Zelalem Eshete
(74) *Attorney, Agent, or Firm* — Westerman, Hattori, Daniels & Adrian, LLP

(57) ABSTRACT

The inventive phase varying apparatus (50) has a drive rotor (51) driven by the crankshaft of the engine, a phase angle varying mechanism (54) for varying the phase angle of the camshaft relative to the crankshaft, and a self-locking mechanism (56) for preventing a gap in phase angle between the drive rotor and the camshaft due to an externally input disturbing torque. The self-locking mechanism has a cylinder section (69) mounted on the drive rotor, a circular eccentric cam (64) integrated with the camshaft and having inside thereof a cam holding groove (68*a*), and a lock plate (68) rotatably supporting the periphery of the circular eccentric cam and having on the outer periphery thereof at least four radial abutment protrusions (74-77) that are adapted to abut against the inner periphery (69*a*) of the cylinder section (69) to perform self-locking.

4 Claims, 10 Drawing Sheets

(a)

(a)

SECTION B–B (b)

SECTION D–D (a)

SECTION E-E (b)

SECTION F-F (a)

SECTION E-E (b)

SECTION F-F (a)

(b)

SECTION F-F

SECTION F-F

PHASE VARYING APPARATUS FOR AUTOMOBILE ENGINE TECHNICAL

FIELD OF THE INVENTION

This invention relates to a phase varying apparatus for varying the relative phase angle between a camshaft and the crankshaft of an automobile engine to vary timing of opening/closing a valve (hereinafter referred to as valve timing) of the engine, the apparatus equipped with a self-locking mechanism for preventing undesirable phase angle change caused by an external disturbing torque.

BACKGROUND ART

Patent Document 1 listed below discloses a phase angle varying apparatus (referred to as phase varying apparatus 1) for varying the relative phase angle between the crankshaft and the camshaft to change valve timing, the apparatus 1 equipped with a self-locking mechanism for preventing an undesirable change in phase angle caused by an external disturbing torque. The phase varying apparatus 1 is adapted to advance the phase angle of the camshaft relative to the crankshaft (not shown) in the phase advancing direction D1 or in the phase retarding direction D2 so as to recover the valve timing as required. This is done by enabling either a first electromagnetic clutch first electromagnetic clutch 21 or a second electromagnetic clutch 38 as shown in FIG. 1 of the Patent Document 1.

In the phase varying apparatus 1, the camshaft (not shown) has a center shaft 7 integral therewith, which rotatable supports a drive rotor 2 driven by the crankshaft as shown in, for example, FIG. 1. The center shaft 7 has a circular eccentric cam 12. The center shaft 7 is integrated, via a lock plate bush 13, with a lock plate 14 that holds the circular eccentric cam 12 ad with a first control rotor 3 by means of a coupling pin 2*a*. The camshaft (not shown) rotating together with a drive rotor 2 is in rotation in the D1 direction together with the drive rotor 2 when the first electromagnetic clutch 21 is not activated. When, however, the first control rotor 3 is retarded by the braking action of the first electromagnetic clutch 21, the camshaft is retarded relative to the drive rotor 2, thereby changing the phase angle of the camshaft relative to the drive rotor 2 in the D2 direction. On the other hand, the drive rotor 2 is integrated with a pin guide plate 33 via a first link pin 34. When the second electromagnetic clutch 38 puts a brake on a second control rotor 32, the first link pin 34 is displaced in a first radially shrinking guide groove 31 of the first control rotor 3 and a guide groove 33*b* extending in a substantially radial direction (hereinafter referred to radial guide groove 33*b*) of the pin guide plate 33, thereby rotating the camshaft in the D1 direction relative to the drive rotor 3. Consequently, the phase angle of the camshaft relative to the drive rotor is advanced in the D1 direction.

On the other hand, the phase varying apparatus of Patent Document 1 is equipped with a self-locking mechanism 11 for preventing the a change in phase angle between the camshaft and the drive rotor 2 from occurring by unrotatably fixing the lock plate 14 to the drive rotor 2. This locking of the lock plate is enabled by taking advantage of the external disturbing torque inputted to the camshaft which otherwise results in an angular displacement of the camshaft. Describing the self-locking mechanism 11 in more detail, the drive rotor 2 is a body comprising a sprocket 4 and a drive cylinder 5 integrated together and the lock plate 14 is inscribed in the inner periphery 20*a* of the cylinder section 20 of a drive cylinder 5. In what follows the line passing through the central axis L0 of the camshaft (the axis referred to as camshaft axis L0) and the cam center L1 of the circular eccentric cam 12 will be referred to as line L2, the line crossing the line L2 at the cam center L1 at a right angle referred to as line L3, the points at which the line L3 intersects the inner periphery 20*a* referred to as P3 and P4, as shown in FIG. 7 of the Patent Document 1. The angles made by the line L4 tangent to the lock plate 68 at the points P3 and P4 and the line L5 perpendicular to the line L3 will be referred to as θ1 and θ2, respectively. The coefficient of friction between the inner periphery 20*a* and the periphery of the lock plate 14 will be referred to as μ.

When the camshaft is subjected to an external disturbing torque that has arisen from reaction of a valve (not shown) and forces the camshaft to rotate in the D2 or the D1 direction, the cam center L1 of the circular eccentric cam 12 is forced to rotate about the camshaft axis L0, generating radially outward forces F1 and F2 acting on the inner periphery 20*a* in contact with the lock plate 14 at the points P3 and P4.

Under this condition, the tangential components of the three F1 and F2 acting on the periphery of the lock plate 14 are F1*sin θ1 and F2*sin θ2 respectively, urge the lock plate 14 to rotate within the cylinder section 20. On the other hand, the normal components of the forces F1*sin θ1 and F2*sin θ2, respectively, press the lock plate 14 onto the inner periphery 20*a* and generate frictional forces, μ*F1*sin θ1 and μ*F2*sin θ2 respectively, in the direction opposite to the tangential forces. When the tangential forces exceed the opposing frictional forces, the camshaft is rotated together with the locked lock plate 14 relative to the drive rotor 2, thereby rendering the camshaft out of phase relative to the crankshaft.

In view of the above-mentioned problem, the self-locking mechanism 11 of the Patent Document 1 is configured such that, when an external disturbing torque is transmitted to the crankshaft, the frictional forces overcome the tangential components to stop the rotation of the lock plate 14 and prevent an undesirable gap in phase angle from occurring between the camshaft and the crankshaft. Specifically, since the lock plate 14 is unrotatably fixed to the drive rotor 2 as a result of the self-locking effect when the following conditions $$\mu * F1 * \cos\theta 1 > F1 * \sin\theta 1 \text{ and } F2 * \sin\theta 2 > \mu * F2 * \cos\theta 2,$$

are met, the angles θ1 and θ2 of the phase varying apparatus of the Patent Document 1 are set such that $$\theta 1 < \tan^{-1}\mu \text{ and } \theta 2 < \tan^{-1}\mu$$

PRIOR ART DOCUMENT

Patent Document

Patent Document 1 PCT/JP2010/58370

SUMMARY OF THE INVENTION

Objects to be Achieved by the Invention

The self-locking effect of the phase varying apparatus of the Patent Document 1 is enhanced by decreasing the angles θ1 and θ2 to increase the frictional farces while decreasing the tangential components. In the phase varying apparatus of the Patent Document 1, there are two ways to decrease the angles θ1 and θ2. One way is to shorten the eccentric distance L of the circular eccentric cam 12 (which is defined to be the distance between the camshaft axis L0 and the cam center L1), and another is to increase the inner diameter of the lock plate 14 and the radius R of the cylinder section 20. However, these two ways have the following disadvantages.

First, it is not possible to avoid having a minute manufacturing gap between the lock plate bush 13 and the cam holding groove 15 of the lock plate 14. Since the circular eccentric cam 12 is held in the cam holding groove 15 via the intervening lock plate bush 13, the circular eccentric cam 13 will rotate under the influence of an external disturbing torque together with the intervening lock plate bush 13 through an angle that depends on the manufacturing gap until the lock plate bush 13 comes into contact with the cam holding groove 15. Thus, in the above-mentioned self-locking mechanism, the larger is the gap between the lock plate bush 13 and the cam holding groove 15, the larger is the angular displacement (or rotational angle) of the lock plate bush 13 prior to touching the cam holding groove 15, so that the self-locking mechanism requires a long time to take effect. The rotational angle of the lock plate bush 13 decreases with increasing eccentric distance L of the circular eccentric cam 12 (and increases with the decreasing eccentric distance L). It is noted that by shortening the eccentric distance L of the circular eccentric cam 12 the self-locking effect is enhance but loses its certainty. On the other hand, increasing the outer diameter of the lock plate 14 and the radius R of the cylinder section 20enhances the self-locking effect on one hand, but makes the phase varying apparatus bulky on the other hand, and reduces the degrees of freedom in the arrangement of the apparatus in the engine.

Through deliberate examinations of such self-lock mechanism, the inventors of the present invention have found a measure to improve the self-locking function even better when the eccentric distance L of the circular eccentric cam 12 is increased in an attempt to reduce the backlash of the lock plate bush and the radius R is decreased. This can be done by changing the contact position of the lock plate 14 on the inner periphery of the cylinder section of the drive rotor from a conventional position to a new position.

It is, therefore, an object of the present invention to provide a reliable phase varying apparatus for an automobile engine that can provide an enhanced self-locking effect.

Means for Achieving the Object

There is provided in accordance with the present invention defined in claim 1 a phase varying apparatus having a drive rotor driven by the crankshaft of the engine, a control rotor, a camshaft for rotatably and coaxially supporting the drive rotor, a torque provision means for providing the control rotor with a torque to rotate the control rotor relative to the drive rotor, a phase angle varying mechanism for varying the relative phase angle between the camshaft and the drive rotor in response to the rotation of the control rotor relative to the drive rotor induced by an external disturbing torque, and a self-locking mechanism, installed in the phase angle varying mechanism, for preventing a gap in phase angle from occurring between the drive rotor and the camshaft caused by an external disturbing cam torque, the phase angle varying apparatus characterized in that.

the self-locking mechanism comprises:

a cylinder section mounted on the drive rotor;

a circular eccentric cam integral with the camshaft; and a lock plate having a coin holding groove for holding therein the circular eccentric cam, and the lock plate is provided on the periphery thereof with at least four radial abutment protrusions in smooth contact with the inner circumference of the cylinder section.

(Function) The self-locking mechanism exhibits self-locking effect when the frictional torque generated by the friction between the abutment protrusions and the inner circumference of the cylinder section overcomes the torque generated by an external disturbing torque and urging the lock plate to rotate relative to the cylinder section.

The intensity of the self-locking effect increases with the circumferential spacing of the radial abutment protrusions formed on the periphery of the lock plate. In other words, in the self-locking mechanism of claim 1, the intensity of the self-locking effect depends on the spacing between the radial abutting sections. Thus, the self-locking effect, can be better effected by increasing the eccentric distance of the circular eccentric cam even when the radius of the lock plate is reduced.

There is provided a phase varying apparatus in accordance with the present invention as defined in claim 2, having a drive rotor driven by the crankshaft of the engine, a control rotor, a camshaft for rotatably and coaxially supporting the drive rotor, a torque provision means for providing the control rotor with a torque to rotate the control rotor relative to the drive rotor, a phase angle varying mechanism for varying the relative phase angle between the camshaft and the drive rotor in response to the rotation of the control rotor relative to the drive rotor, and a self-locking mechanism for preventing a gap in phase angle from occurring between the drive rotor and the camshaft caused by an external disturbing cam torque, the phase angle varying apparatus characterized in that the self-locking mechanism comprises:

a cylinder section mounted on the drive rotor;

a circular eccentric cam integral with the camshaft; and a lock plate having a cam holding groove for supporting the circular eccentric cam, the cam holding groove having an abutment faces in abutting contact with the periphery of the circular eccentric cam, with the abutment faces formed only in a restricted region of the lock plate offset from the line passing through the cam center perpendicularly in the eccentricity direction of the cam, where the eccentricity direction is defined to he the direction of the half line that extends from the camshaft axis towards the cam center of the eccentric cam.

(Function) By providing the abutment faces of the cam holding groove only in the restricted region of the lock plate as described above so as to bring the contact point of the lock plate and the cam holding groove at a predetermined position, an unexpected excessive friction will not take place between the lock plate and the cam holding groove when the camshaft is subjected to an external disturbing torque. Consequently, in the self-locking mechanism of the phase varying apparatus defined in claim 2, unexpected locking of the lock plate in the cam holding groove or inability of desired unlocking of the self-locking mechanism is avoided.

In the phase varying apparatus defined in claim 1 or 2, the lock plate may he divided into two sections by a pair of radial slits that extend from the cam holding groove to the periphery of the lock plate, with one slit provided with a means for widening the slit, as defined in claim 3.

(Function) With the lock plate divided into two sections by the paired slits, a torque generated by an external disturbing torque and acting on one section will not be transmitted to the other section, thereby suppressing the rotation of the lock plate by the torque and enhancing the pressure of the lock plate against the cylinder section of the drive rotor. It is noted that the means for widening the slit lessens the manufacturing gap formed between the lock plate and the cylinder section, so that the pressure of the lock plate is instantly applied to the cylinder section of the drive rotor at the moment when an external disturbance has occurred.

There is also provided a phase varying apparatus according to any one of claims 1 through 3, wherein the drive rotor has a sprocket which is integral with its cylinder section and driven by the crankshaft, with the lock plate arranged at a predetermined axial position between the cylinder section and the sprocket, as defined in claim 4.

(Function) Because of the self-locking effect, when the lock plate is pressed against the inner periphery of the drive cylinder, there appear rotational moments at the portions of the camshaft where the lock plate and the sprocket are supported, in such a way that the rotational moments urge rotation of the circular eccentric cam about the axis of the camshaft. If both of the supporting points are located either ahead or behind the circular eccentric cam, the camshaft is subjected to an axial distortion. Such distortion causes local friction between the members supported by the camshaft, which can impair normal operation of the phase angle varying mechanism and/or the self-locking mechanism.

In the fourth form of the phase varying apparatus defined in claim 4, the lock plate is arranged between the sprocket and the drive cylinder integrated with the sprocket, so that the drive cylinder and the sprocket are located ahead and behind the circular eccentric cam, respectively. Consequently, the rotational moments generated at the supporting portions have opposite directions and cancel out. Accordingly, the axial distortion of the camshaft will not, take place, nor does such local friction as described above. In other words, in the phase angle varying mechanism defined in claim 4, the functions of the phase varying apparatus no of self-locking mechanism is not impaired by the lock plate.

Results of the Invention

According to the invention defined in claim 1, it is possible to provide a compact phase varying apparatus equipped with a reliable self-locking mechanism having a quick-response. Thus, the invention increases design freedom of the phase varying apparatus.

In accordance with the second embodiment of the invention, it is possible to provide a phase varying mechanism equipped with a self-locking mechanism capable of infallibly performing self-locking and unlocking of the phase varying mechanism, thereby preventing an excessive friction from occurring between the lock plate and the cam holding groove.

In the phase varying apparatus defined in claim 2 the self-locking mechanism has an enhanced reliability.

BEST MODE FOR CARRYING OUT THE INVENTION

Figure 1:
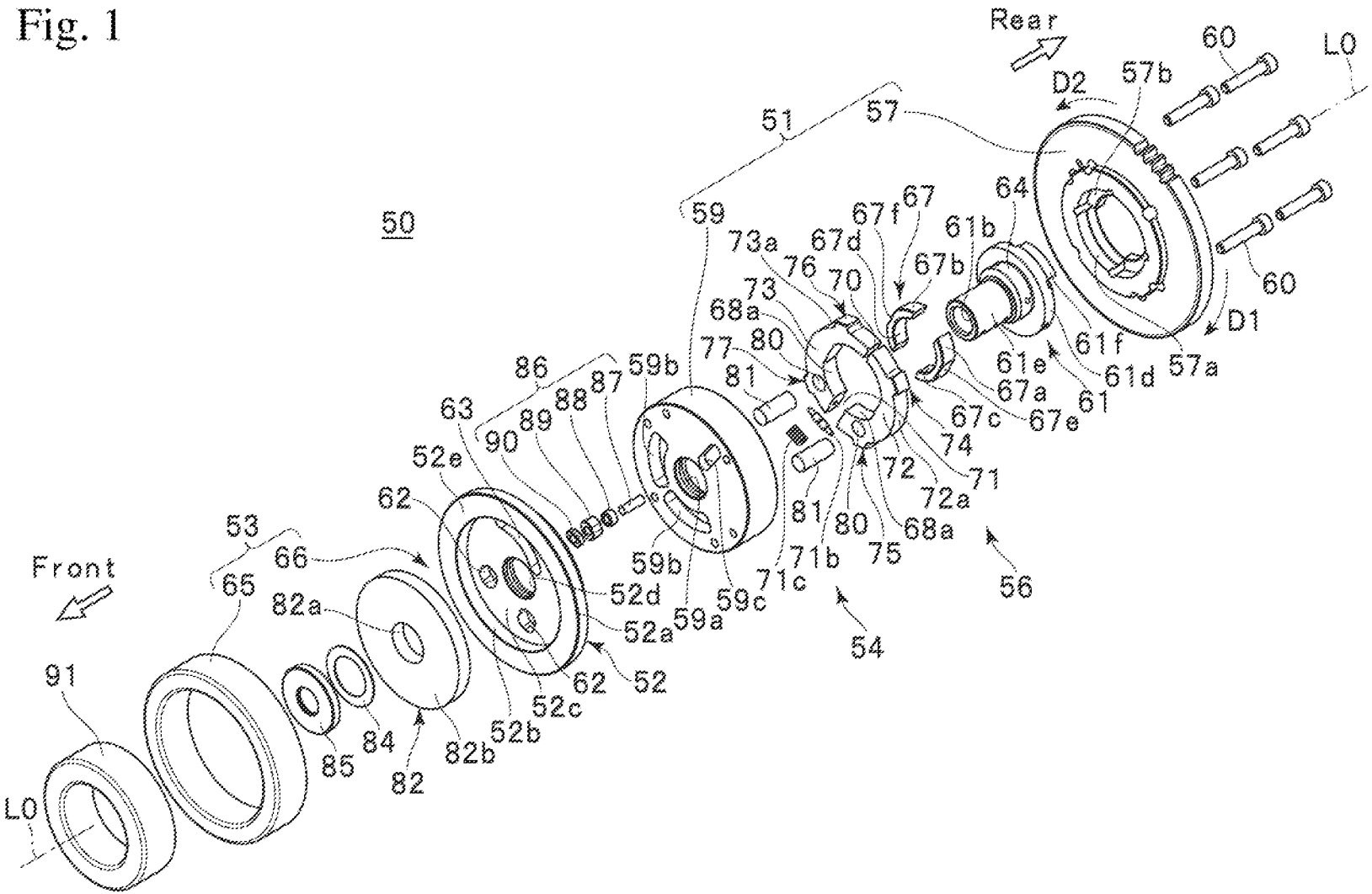
FIG. 1 is an exploded perspective view of a phase varying apparatus for an automobile engine in accordance with a first embodiment of the invention as viewed from the front end thereof.
Figure 2:
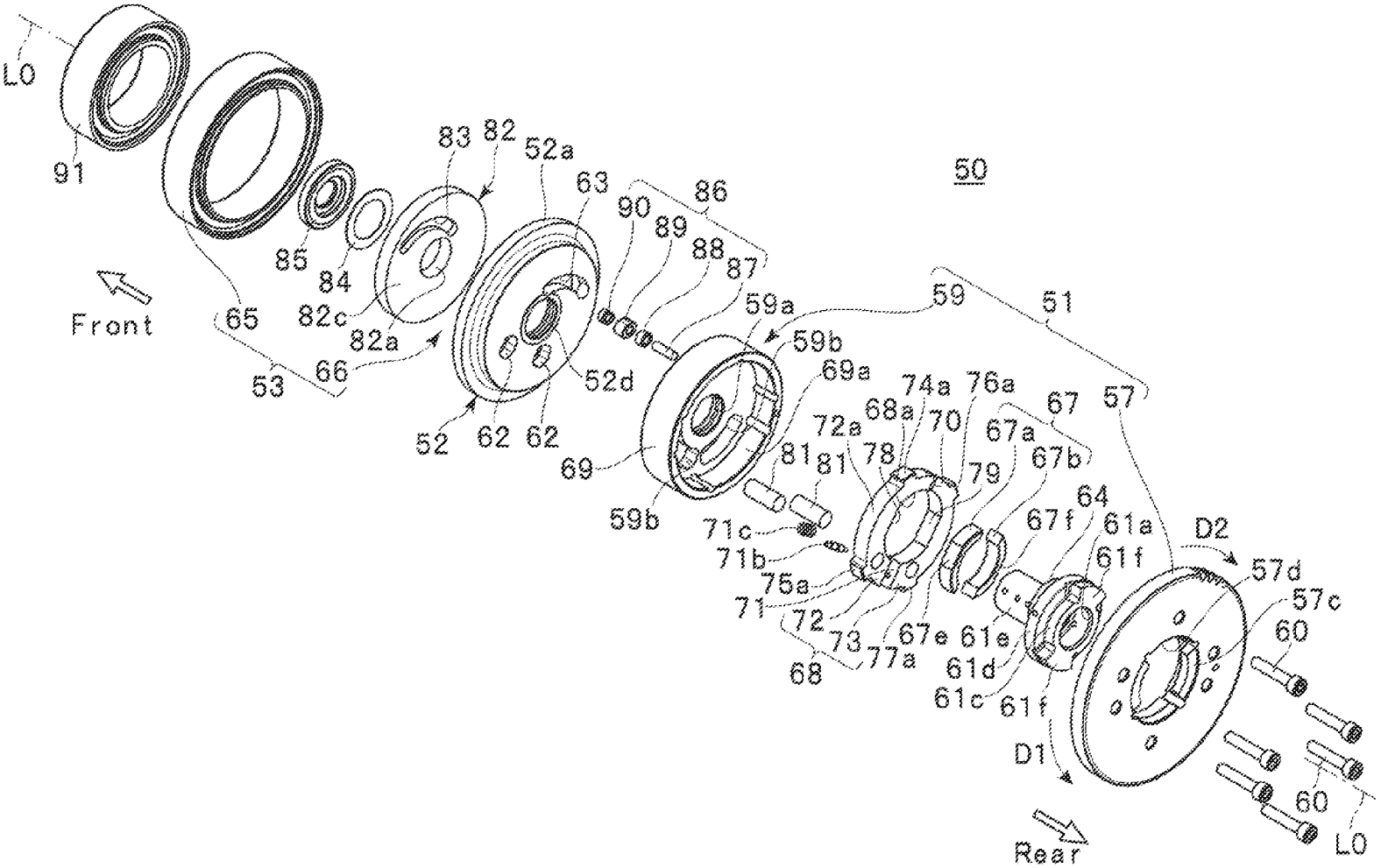
FIG. 2 is an exploded perspective view of the apparatus shown in FIG. 1 as viewed from the rear end thereof.
Figure 3:
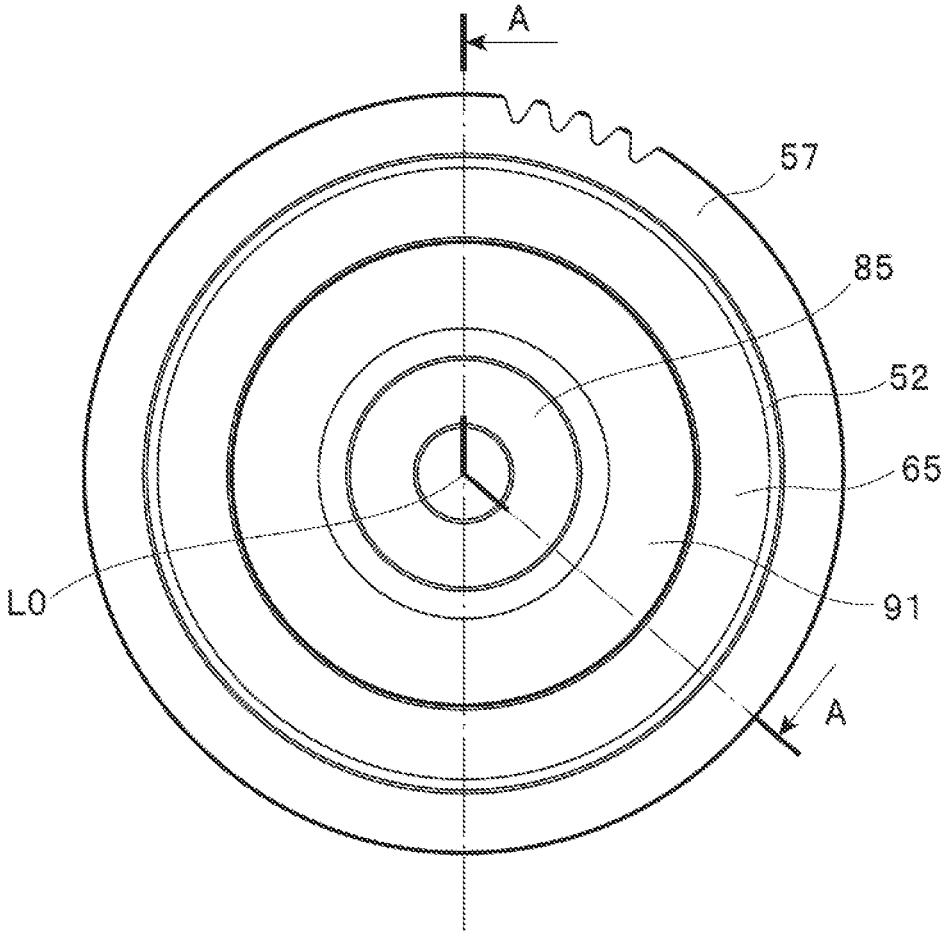
FIG. 3 is a front view of the phase varying apparatus shown in FIG. 1.

The present invention will now be described in detail by way of example with reference to the accompanying drawings. Phase varying apparatuses in accordance with the respective embodiments are mounted in an automobile engine to vary the valve timing of an air intake/exhaust valve depending on such operational parameters of the engine as the load and rpm of the engine, while transmitting the rotational motion of the crankshaft to the camshaft, of the apparatus to open/close the valve in synchronism with the crankshaft.

The structure of a first embodiment will now be described with reference to FIGS. 1 through 9. A phase varying apparatus 50 of the first embodiment includes a drive rotor 51 driven by the crankshaft (not shown) of the engine, a first control rotor 52 (which is the control rotor defined in claim 1), a camshaft (not shown), a torque provision means 53, a phase angle varying mechanism 54, and a self-locking mechanism 56. In what follows one end of the phase varying apparatus having a second electromagnetic clutch 91 will be referred to as the front end, while the other end having the drive rotor 51 referred to as the rear end. The clockwise direction of the drive rotor 51 about the camshaft as viewed from the front end will be referred to as phase advancing direction D1, and the opposite (counterclockwise) direction will be referred to as phase retarding direction D2.

The drive rotor 51 includes a sprocket 57 driven by the crankshaft and a drive cylinder 59 having a cylinder section 69, integrated with a fixing pin 60. The camshaft (not shown) is engaged with a fixing hole 61*a* formed in the rear end of the center shaft 61 and securely fixed to the center shaft 61 with a bolt (not shown) inserted in a central circular hole 61*b* of the center shaft, 61.

The first control rotor 52 is a bottomed cylinder having a flange section 52*a* formed round the front edge of the cylinder section 52*a*. The bottom 52*c* is provided with a central circular through-hole 52*d*, a pair of pin holes 62, and a first curved guide groove 63 that extends in the phase advancing direction with its radius from the camshaft axis L0 decreasing (the groove hereinafter referred to as first radially shrinking guide move 63)

The center shaft 61 consists of a first cylinder section 61*c*, a flange section 61*d*, a circular eccentric cam 64 having a center L1 offset from the camshaft axis L0, and a second cylinder section 61*e*, altogether contiguously and coaxially arranged in the forward direction in the order mentioned (FIG. 1). The first cylinder section 61 *c* is provided with a pair of fan-shaped engagement protrusions 61*f* spaced apart across the camshaft axis L0. The sprocket 57 and the drive cylinder 59 are arranged across the center shaft 61 and integrated together with fixing pins 60.

The sprocket 57 has a large circular hole 57*a* and a small stepped circular hole 57*c* formed in succession in the bottom section 57*b*. The bottom section 57*b* also has pair of fan-shaped engagement recesses 57*d* across the camshaft axis L0. These recesses have a larger are than fan-shaped engagement protrusions 61*f*. The sprocket 57 is rotatably mounted on the center shaft 61, with the flange section 61*d* engaged in the large circular hole 57*a*, the first cylinder section 61 *c* engaged in the small circular hole 57*b*, and the fan-shaped engagement protrusions 61*f* inserted in the engagement recesses 57*d*.

The drive cylinder 59 has a pair of grooves 59*b* extending in the circumferential direction of the drive cylinder 59 round the circular hole 59*a* (the groove referred to as circumferential grooves 59*b*), and a guide groove 59*c* extending m a substantially radial direction of the drive cylinder 59 (the groove 59*c* hereinafter referred to as radial groove). The second cylinder section 61*e* is rotatably engaged in the central circular hole 59*a* so as to rotatably support the drive cylinder 59. When the drive rotor 51 rotates relative to the center shaft 61, the engagement recesses 57*d* of the sprocket 57 serves as a stopper for stopping the movement of the fan-shaped engagement protrusions 61*f* to limit the rotational motion of the center shaft 61 within a limited range. The first control rotor 52 is rotatably supported, ahead of the drive cylinder 59, by the second cylinder section 61e engaged in the circular through hole 52*d*. Consequently, the drive rotor 51, the first control rotor 52 and the center shaft 61 integral with the camshaft (not shown) are coaxially arranged along the camshaft axis L0.

The torque provision means 53 comprises a first electromagnetic clutch 65 for putting a brake on the first control rotor 52 so as to rotate the first control rotor 52 relative to the drive rotor 51, and a reversing mechanism 66 for providing the first control rotor 52 with a torque in the direction opposite to that given by the first electromagnetic clutch 65. The first electromagnetic clutch 65 is fixed to the engine (not shown) at a position ahead of the first control rotor 52. When the first electromagnetic clutch 65 is energized, the front end 52*e* of the flange section 52*a* is attracted onto the friction member 65*a*, so that the first control or 52 is retarded relative to the drive rotor 51 rotating in the D1 direction.

On the other hand, the reversing mechanism 66 consists of the first radially shrinking guide groove 63 of the first control rotor 52, a second control rotor 82 having a second radially shrinking guide groove 83 (described later), and a second electromagnetic clutch 87 for putting a brake on a link pin 86 and on the second control rotor 82.

The phase angle varying mechanism 54 consists of a sequential mechanical system for operably integrating the camshaft and the first control rotor 52 and the radially shrinking guide groove 59*c* of the chive cylinder 59 for guiding the link pin 86 of the reversing mechanism 66 in a substantially radial direction. More particularly, the sequential mechanical system comprises the circular eccentric cam 64 mounted on the center shaft 61, a lock plate bush 67, a lock plate 68 having a pair of circular holes 80, and a pair of pin holes 62 formed in the first control rotor 52.

The self-locking mechanism 56 is arranged between the drive rotor 51 and the center shaft 61 to prevent an external disturbing torque arising from the force of a valve spring from generating a gap in phase angle between the drive rotor 51 and the camshaft. The self-locking mechanism 56 consists of the circular eccentric cam 64 mounted on the center shaft 61, the lock plate bush 67, the lock plate 68 having radial abutment protrusions 74-77 (described later), and the cylinder section 69 having an inner circumferential surfaces 69*a* for inscribing the radial abutment protrusions 74-77.

The lock plate bush 67 consists of a pair of symmetric, constituent members 67*a* and 67*b*. The constituent members 67*a* and 67*b* have an inner circumferential faces 67*c* and 67*d*, respectively, adapted to engage with the circular eccentric cam 64 of the center shaft 61, and have a pair of flat faces 67*e* and 67*f*, respectively, formed on their outer peripheries, as shown in FIG. 1.

The lock plate 68 has an oblong central cam holding groove 68*a* and consists of a pair of constituent members 72 and 73 separated by a pair of straight slits 70 and 71 that extend straight from the groove to the periphery of the lock plate 68. The slit 71 has a larger width than the slit 70. The lock plate 68 as a whole has a generally circular circumference. Each of the constituent members 72 and 73 is provided on the periphery 72*a*/73*a* with two of the four abutment protrusions 74-77 extending in radially outward directions of the cylinder section 69. The peripheral surfaces 74*a*-77*a* of the abutment protrusions are aligned with the same circle. The cam holding groove 68*a* is provided on the right and left sides thereof with flat faces 78 and 79, which are in contact with the paired flat faces 67*e* and 67*f* to hold the constituent members 67*a* and 67*b* in position.

Figure 4:
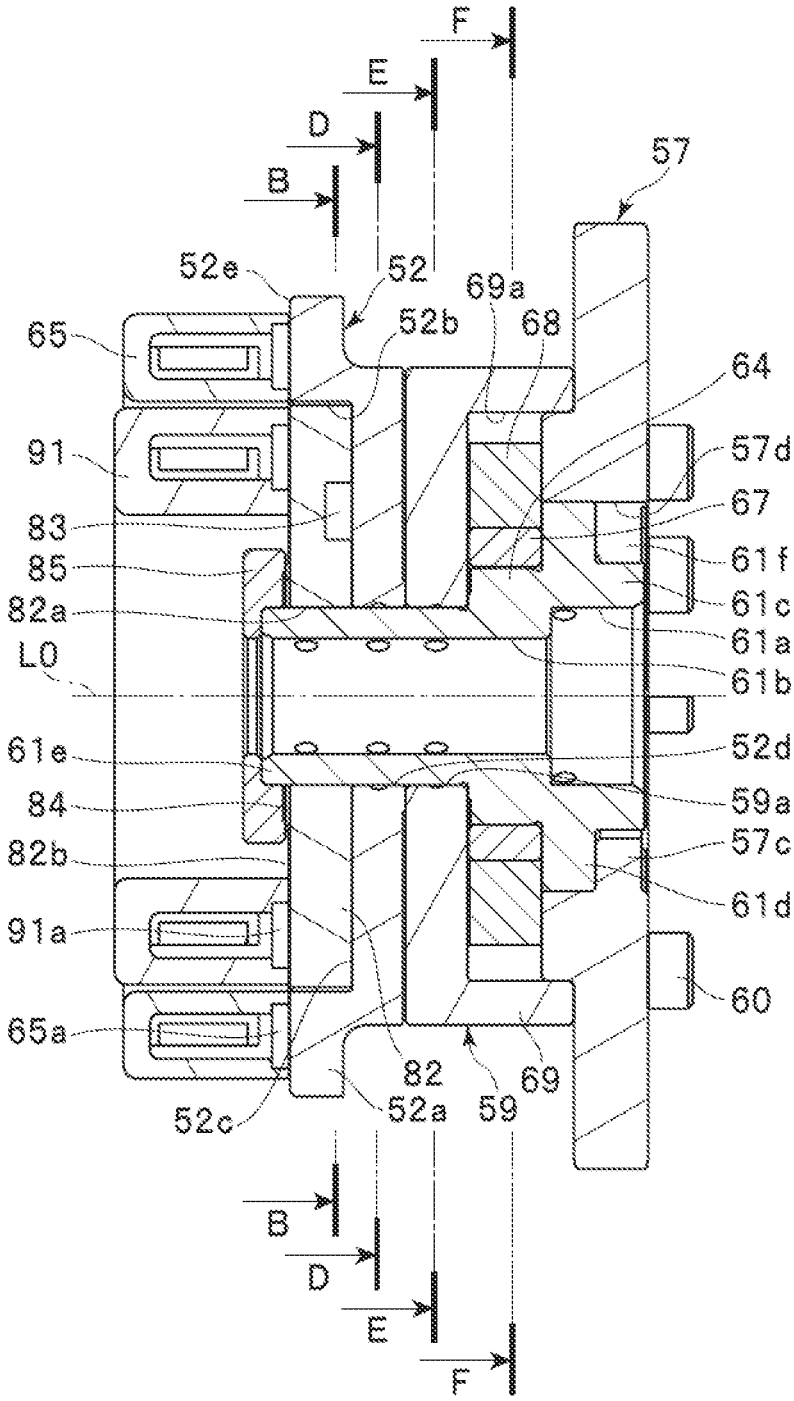
FIG. 4 is a cross section of the phase varying apparatus taken along A-A in FIG. 3.

It is noted that the lock plate 68 is arranged between the sprocket 57 and the drive cylinder 59 which are securely fixed together with connecting pins, as shown in FIG. 4. When the camshaft is subjected to an external disturbing torque, the circular eccentric cam 64 exerts a force to the lock plate 68 via the lock plate bush 67 in the direction perpendicular to the camshaft axis L0 and pushes the lock plate 68 against the inner periphery 69*a* of the cylinder section 69. Under this condition, the second cylinder section 61*e* and the flange section 61*d* of the center shaft 61 is subjected to downward forces exerted by the drive cylinder 59 and the sprocket 57, respectively, as shown in FIG. 4. These downward forces acting on the second cylinder section 61*e* and the flange section 61*d* provide the center shaft 61 with torques in the opposite directions across the circular eccentric can 64, so that the center shaft 61 will not be inclined by the torques relative to the camshaft axis L0 nor impair the operation of the phase angle varying mechanism 54 and the self-locking mechanism 56.

Figure 6:
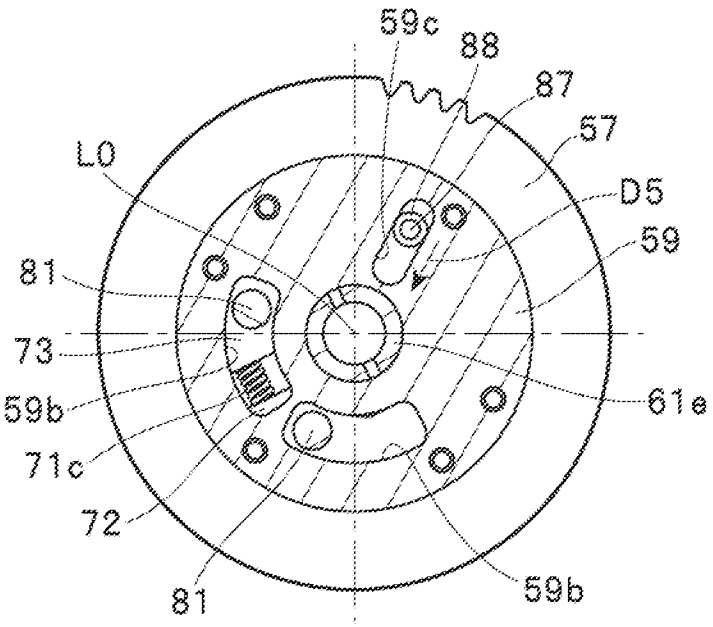
FIGS. 6(*a*) and 6(*b*) are cross sections of the inventive phase varying apparatus taken along E-E and F-F in FIG. 4, respectively.
Figure 6:
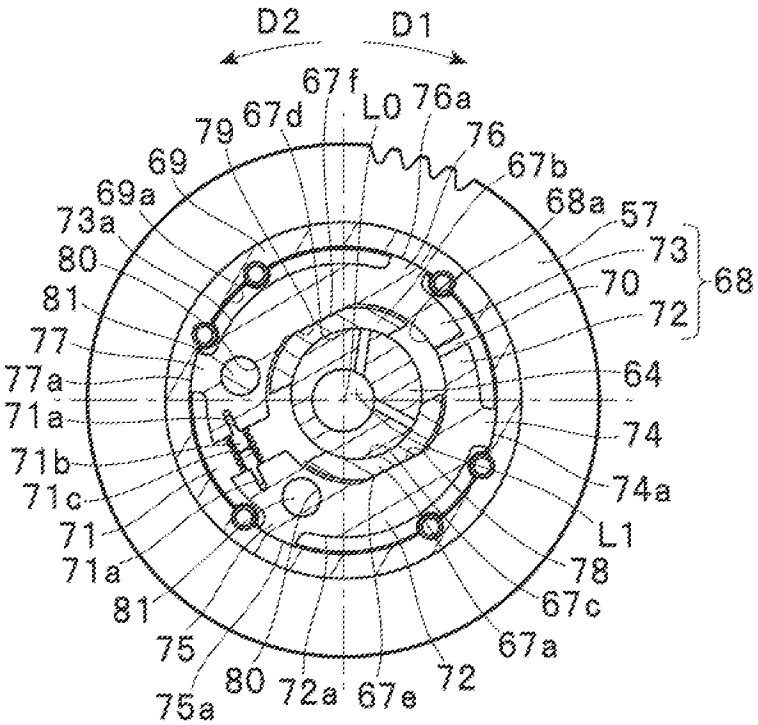

As shown in FIG. 6, a spring mounting member 71*b* is fitted in a pair of opposing mounting holes 71*a* across the slit 71. A compression coil spring 71*c* for bring the constituent members 72 and 73 of the lock plate 68 to widen the slit 71 is mounted on the spring mounting member 71*b*. By widening the slit 71, the compression coil spring 71*c* minimizes manufacturing gaps formed between the peripheral surfaces 74*a*-77*a* of the abutment protrusions and the inner periphery 69*a* of the cylinder section 69 and a similar gap between the lock plate bush 67 and the cam holding groove 68*a*, thereby reducing the backlashes between them and ensuring the self-locking effect.

The lock plate bush 67 is secured in position on the circular eccentric cam 64 fitted in the inner peripheries 67*c*-67*d* of the lock plate 67, with the flat faces 78 and 79 of the lock plate 68 sandwiching the flat faces 67*e*-67*f* of the lock plate bush 67. The lock plate 68 is arranged inside the cylinder section 69 with the peripheral surfaces 74*a*-77*a* of the radial abutment protrusions 74-77 kept in contact with the inner periphery 69*a* of the cylinder section 69 of the drive cylinder 59.

Each of the constituent members 72 and 73 of the lock plate 68 is formed with an axial circular through holes 80 for incorporating pins 81. The pins 81 are engaged in the paired circumferential grooves 59*b* and in the paired pin holes 62 of the first control rotor 52, such that the pins 81 are in line contact with the pin holes 62 to unrotatably link the first control rotor 52 with the lock plate 68.

The second control rotor 82 is placed in the inside 52*b* of the flange section 52*a* of the first control rotor 52. The second control rotor 82 has a central circular through-hole 82*a* and a second radially shrinking guide groove 83 formed in the rear end 82*c* of the second control rotor 82 and surrounding the circular through-hole 82*a*. The second control rotor 82 is rotatable supported by the center shaft 61 by engaging the second cylinder section 61 *e* in the circular through-hole 82*a*. A retaining holder 85 and a washer 84 are mounted on the leading end of the second cylinder section 61*e* supporting the second control rotor 82, and securely fixed with bolts (not shown). The bolt is inserted into the central circular hole 61*b* from front and screwed into a central threaded bore.

The second electromagnetic clutch 91 is arranged ahead of the second control rotor 82 and secured inside the engine (not shown). When energized, the second electromagnetic clutch 91 attracts the front end 82*b* of the second control rotor 82 onto the friction member 91*a* of the second electromagnetic clutch 91, causing the second control rotor 82 to be retarded relative to the drive rotor 51 rotating in the D1 direction.

The link pin 86 is inserted in the radially shrinking guide groove 59*c*, first radially shrinking guide groove 63, and second radially shrinking guide groove 83. The link pin 86 consists of a thin shaft 87, a ring member 88, a first hollow shaft 89, and a second hollow shaft 90. Each of the link member 88, first hollow shaft 89 and second hollow shaft 90 has a central circular hole of the same diameter as the outer diameter of the thin shaft 87, and is rotatably fitted on the thin shaft 87 from rear in the order mentioned. The link member 88 has the same outer diameter as the width of the radially shrinking guide groove 59*c* so as to be slidably held in the radially shrinking guide groove 59*c*. The first hollow shaft 89 has the same outline as the first radially shrinking guide groove 63 so as to be slidably held in the first radially shrinking guide groove 63. The second hollow shaft 90 has the an outline that fits in the second radially shrinking guide groove 83 so as to be slidably fitted in the second radially shrinking guide groove 83. Thus, the link member 88, first hollow shaft 89, and second hollow shaft 90 are slidably held in the respective radially shrinking guide groove 59*c*, first radially shrinking guide groove 63, and second radially shrinking guide groove 83.

If an external disturbing torque is transmitted to the camshaft and causes rotation of the camshaft in the D1 direction, the abutment protrusions 74 and 75 of the constituent member 72 of the lock plate 68 are pressed against the inner periphery 69*a* of the cylinder section 69 by the self-locking mechanism 56. If an external disturbing torque is applied to the camshaft, that causes rotation of the camshaft in the D2 direction, the abutment protrusions 76 and 77 of the constituent members 73 are pressed onto the inner periphery 69*a*. In any case, the drive cylinder 59 is held unrotatable relative to the camshaft.

Referring to FIGS. 5 through 8, there is shown how the phase angle between the camshaft (not shown) and the drive rotor 51 (or crankshaft) is varied by the torque provision means 53. As understood from FIG. 1, the first control rotor 52 is normally rotating together with the drive rotor 51 in the D1 direction. When, however, the front end 52*e* of the first control rotor 52 is attracted by, and onto, the first electromagnetic clutch 65 for braking, the center shaft 61 (or camshaft) is retarded together with the first control rotor 52 in the D2 direction relative to the drive rotor 51. Consequently, the phase angle of the camshaft relative to the drive rotor 51 is changed in the phase retarding direction, thereby changing the valve timing.

Figure 5:
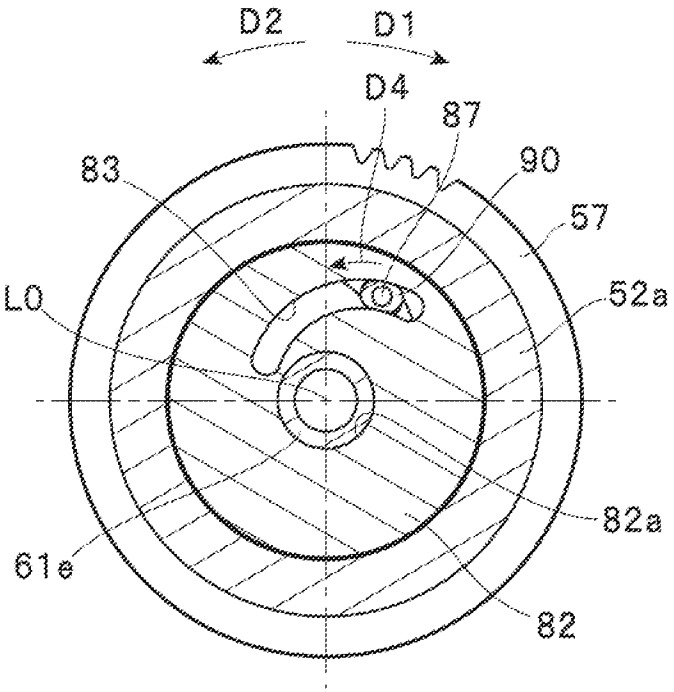
FIGS. 5(*a*) and 5(*b*) are cross sections of the inventive phase varying apparatus taken along B-B and D-D in FIG. 4, respectively.
Figure 5:
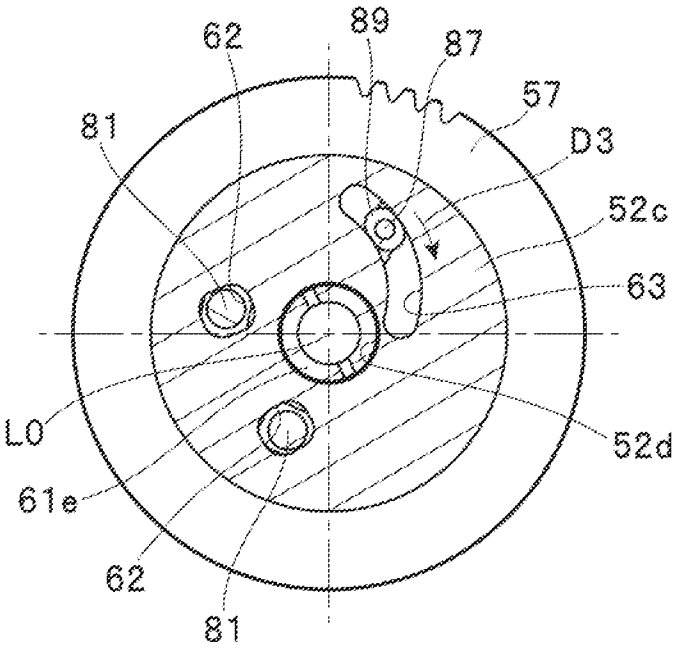

In this case, the first hollow shaft 89 of the link pin 86 shown in FIG. 5(*b*) moves in the first radially shrinking guide groove 63 in the substantially clockwise direction D3. Consequently, the second hollow shaft. 90 shown in FIG. 5(*a*) moves in the second radially shrinking guide groove 83 in the substantially counterclockwise direction D4 to thereby rotate the second control rotor 82 in the phase advancing direction D1 relative to the first control rotor 52, and the link member 88 shown in FIG. 6(*a*) moves in the radially shrinking guide groove 59*c* in the direction D5 towards the camshaft aids L0.

Figure 7:
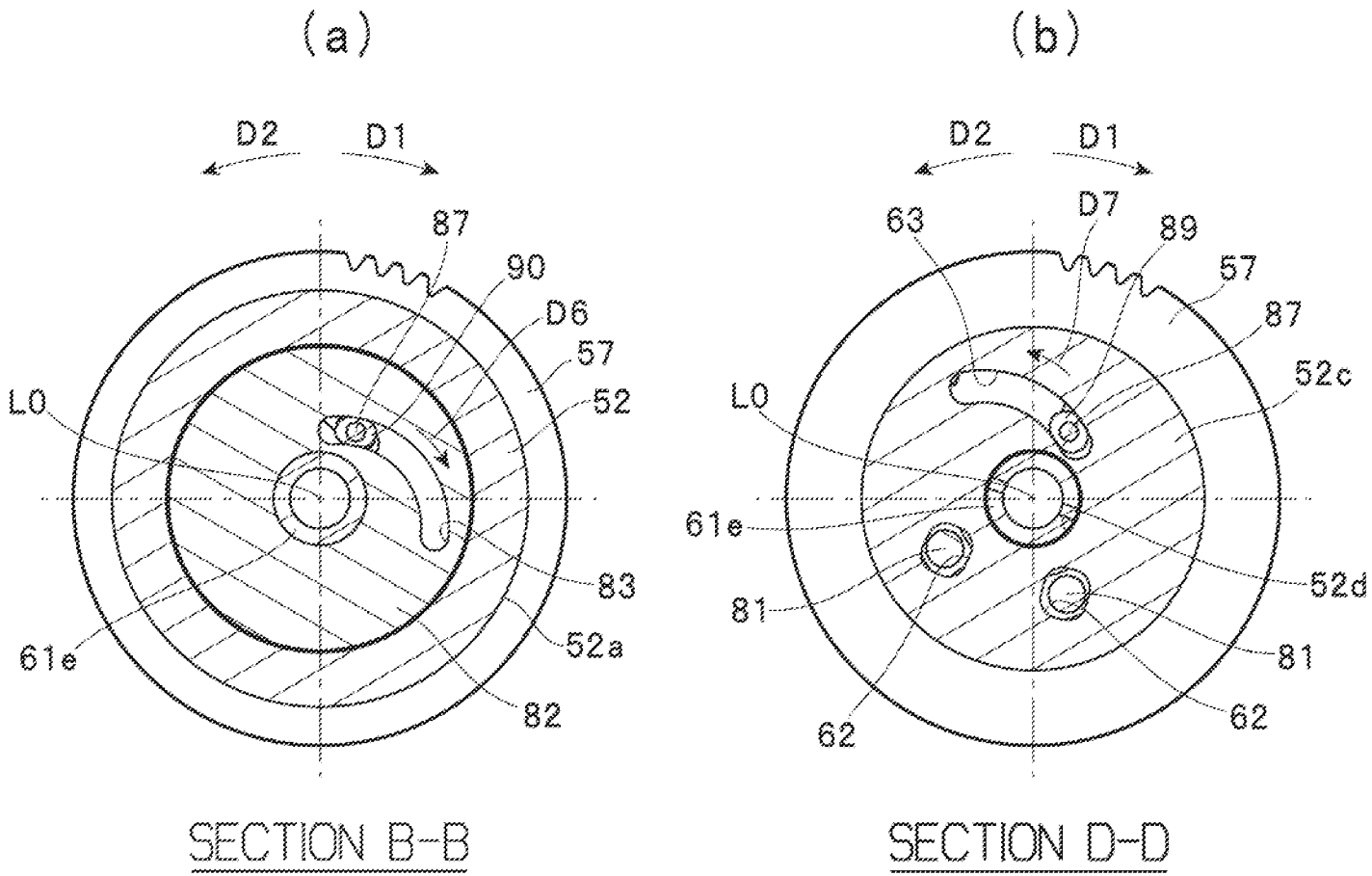
FIGS. 7(*a*) and (*b*) show cross sections of the Phase varying apparatus shown in FIG. 4 after a phase variation, taken along B-B and D-D, respectively, in FIG. 4.
Figure 8:
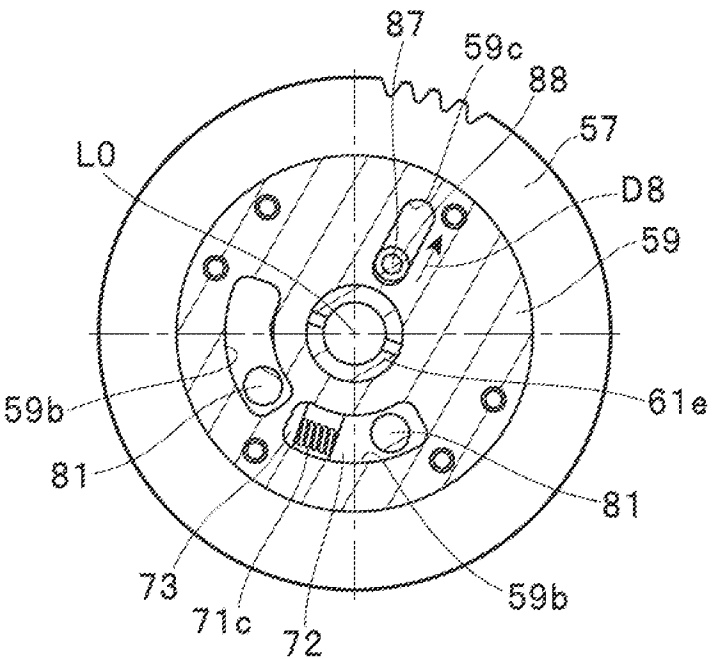
FIGS. 8(*a*) and (*b*) are cross sections of the phase varying apparatus shown in FIG. 4 after a phase variation, taken along E-E and F-F, respectively, in FIG. 4.
Figure 8:
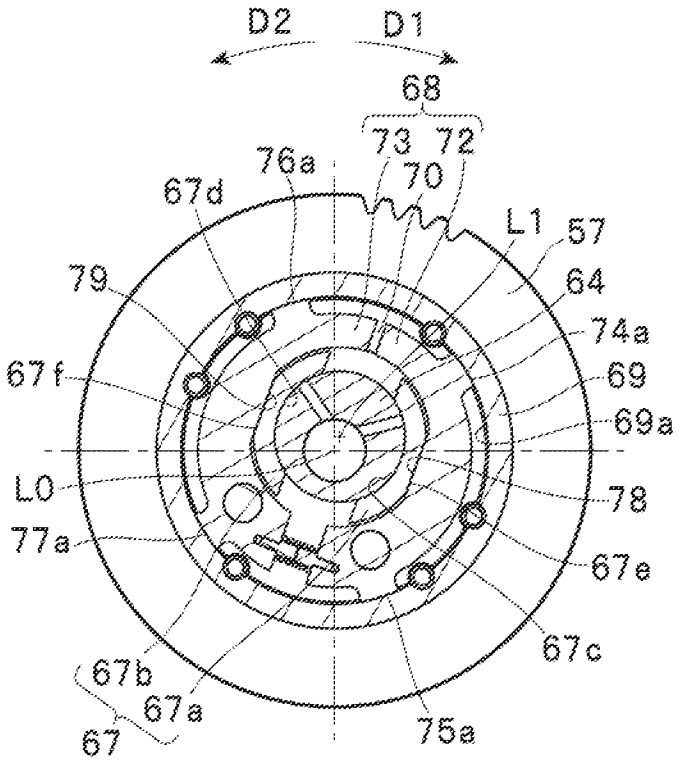

On the other hand, the second control rotor 82 is normally rotating together with the drive rotor 51 in the D1 direction. If, under the condition as shown in FIG. 7(*a*), the second control rotor 82 is subjected to the braking action of the second electromagnetic clutch 91, the front end 82*b* of the second control rotor 82 is attracted onto the friction member 91*a* of the second electromagnetic clutch 91, so that the second control rotor 82 is retarded in the D2 direction relative to the first control rotor 52. In this case the second hollow shaft 90 is moved in the second radially shrinking guide groove 83 in substantially the clockwise direction D6 and hence in the radially inward direction of the second control rotor 82. Under this condition, the bottom 52*c* of the first control rotor 52 shown in FIG. 7(*b*) is subjected to a torque exerted by the first hollow shaft 89, via the first radially shrinking guide groove 63 moving in the substantially counterclockwise direction D7. Thus, the bottom section 52*c* is further rotated in the phase advancing direction D1 relative to the drive rotor 51 (and the sprocket 57). Consequently, the phase angle of the camshaft, (not shown) relative to the drive rotor 51 (or crankshaft, not shown) is returned in the phase advancing direction D1, and the valve timing is changed accordingly.

The self-locking mechanism 56 is arranged between the drive rotor 51 and the center shaft 61 to prevent an unexpected gap in phase angle between the drive rotor 51 and the camshaft from occurring if an external disturbing torque arising from the valve spring (not shown) is transmitted to the camshaft. The self-locking mechanism. 56 consists of the circular eccentric cam 64 of the center shaft 61, the lock plate bush 67, the lock plate 68 having abutment protrusions 74-77 (described later), and the cylinder section 69 of the drive cylinder 59 having the inner periphery 69*a* in contact with the abutment protrusions 74-77.

Next, the self-locking mechanism 56 will now be described in detail with reference to FIG. 1. When subjected to an external disturbing torque, the camshaft (not shown) is urged to rotate relative to the drive rotor 51. Without a means for stopping this relative rotation of the camshaft, the valve timing become inaccurate due to the fact that the phase angle of the camshaft is shifted out of phase with the drive rotor 51. The self-locking mechanism 56 of the embodiment prevents such phase angular deviation with respect to the drive rotor caused by an external disturbing torque.

The effect of the self-locking mechanism 56 is as follows. When an external torque disturbance is transmitted to the camshaft, the circular eccentric cam 64 is urged to rotate about the camshaft axis L0, pushing the lock plate bush 67*a* and 67*b*. Thus, if an external torque causes rotation of the camshaft in the counterclockwise direction D2, the abutment protrusions 78 and 77 formed on the constituent members 73 of the lock plate 68 are pushed by the constituent member 67*b* against the cylinder section 69 of the drive cylinder 59. On the other hand, if the external torque causes rotation in the clockwise direction D1, the circular eccentric cam 64 pushes the constituent member 67*a*, so that the abutment protrusions 74 and 75 of the lock plate 68 are pushed by the constituent members 67*a* against the cylinder section.

n this case, friction takes place between the inner periphery (39*a* and the peripheral surfaces 76*a* and 77*a* or between the inner periphery 69*a* and the peripheries 74*a* and 75*a*. This friction generates a resistive frictional torque urges the camshaft to be rotated via the lock plate 68, lock plate bush 67, circular eccentric cam 64, and the center shaft 61 in the opposite direction of the external torque. The self-locking mechanism 56 of the present embodiment is designed to generate such resistive frictional torque that balances out the external disturbing torque acting on the camshaft to thereby hold the camshaft with respect, to the drive rotor. The effect of this mechanism, or self-locking effect, is the function of this mechanism that causes the drive rotor and the camshaft to be operably integrated by taking advantaged of the external disturbing torque applied to the camshaft.

Figure 9:
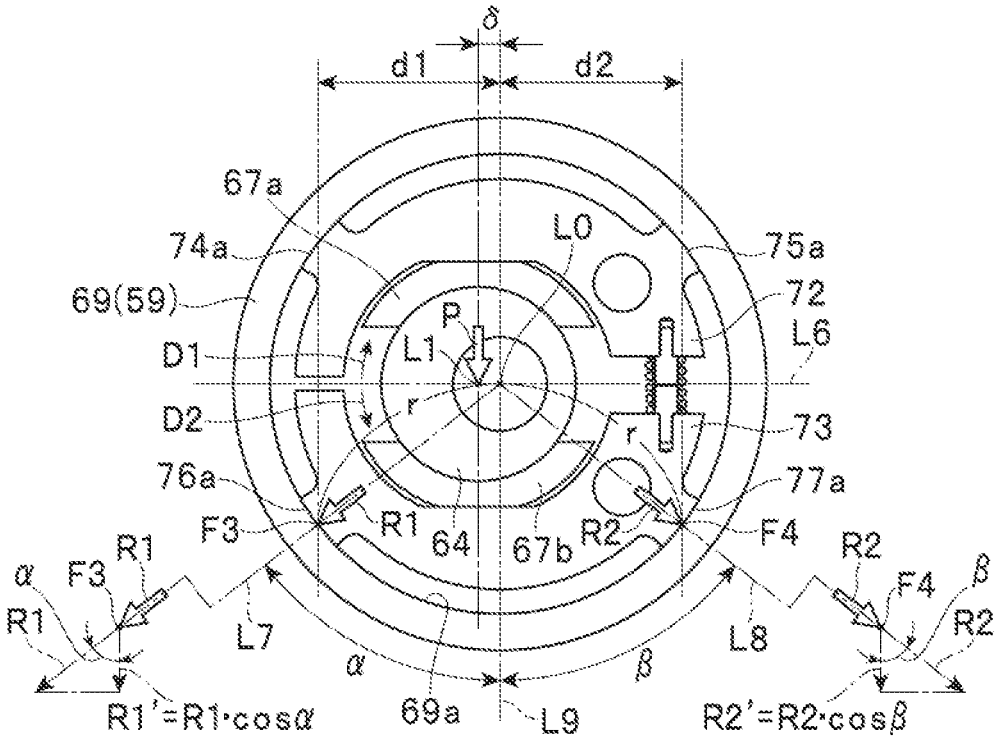
FIG. 9(*a*) is a diagram illustrating functions of the self-locking mechanism of the first embodiment, and FIG. 9(*b*) is a supplementary diagram illustrating a torque balance.
Figure 9:
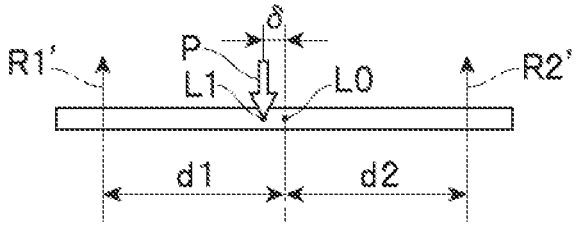

Next, referring to FIG. 9, necessary conditions for realizing the self-locking effect will be described below. Supposing that an external disturbing torque has taken place, causing counterclockwise rotation of the camshaft about its camshaft axis L0, there will be friction between the peripheral surfaces 76*a* and 77*a* of the abutment protrusions 76 and 77 and the inner periphery 69*a* of the cylinder section 69, which urges clockwise-rotation of the camshaft about the camshaft axis L0.

It is assumed here that the cam center L1 of the circular eccentric cam 64 is located on the left hand side of the camshaft axis L0. Then the self-locking effect will take place as follows. In what follows the downward force acting on cam center L1 when an external torque is transmitted to the camshaft is denoted by P; the distance between the camshaft axis L0 and the cam center L1 of the circular eccentric cam 64 by δ; the rotational moment of the force P in the counterclockwise direction D2 by M1; the force imparted by the external torque pressing the abutment protrusions 76 of the lock plate 68 against, the inner periphery 69*a* of the cylinder section 69 by R1; the action point of the force R1 by F3; the force arising from the external torque pressing the abutment protrusion 77 against the inner periphery 69*a* by R2; the action point of the force R2 by F4; the distance from the camshaft axis L0 to the action point of F3 or F4 by r; the horizontal line passing through the cam center L1 by L6; the line passing through the camshaft axis L0 and action point F3 by L7; the line passing through the camshaft axis L0 and the action point F4 by L8; the line passing through the camshaft axis L0 perpendicularly to the line L6 by L9; the angle between the lines L9 and L7 by α; the angle between the lines L9 and L8 by β; the friction factor between the peripheral surfaces 76*a* and 77*a* of the abutment protrusions 76 and 77 and the inner periphery 69*a* by μ1; the rotational moments due to the frictional force acting on the abutment protrusions 76 and 77 in the opposite directions by M2 and M3; the upward and downward components of the forces R1 and R2 acting on the abutment protrusions 76 and 77 in contact with the inner periphery 69*a* by R1' and R2'; and the distances between the camshaft axis L0 and the components R1' and R2' by d1 and d2, respectively.

The self-locking effect occurs when the external disturbing torque and the resistive torque about the camshaft axis L0 balance out, that is, when $$M1=M2+M3 \tag{1}$$

It, is noted that $$M1=P^*\delta \tag{2}$$

$$M2=R1^*\mu1^*r \tag{3}$$

and $$M3=R2^*\mu1^*r \tag{4}.$$

Inserting Eqs. (2) through (4) in Eq. (1), one obtains the following identity formula $$P^*\delta=\mu1^*r^*(R1+R2).$$

Thus, $$\mu1=(\delta/r)^*P^*\{1/(R1+R2)\} \tag{5}$$

On the other hand, because of the equilibrium of the rotational moments and forces shown in FIG. 9, equations (6) and (7) below hold.

$$P^*d-R1'^*d1'^*d1'-R2'^*d2=0 \tag{6}$$

and $$R1'+R2'=P \tag{7}$$

R1' and R2' are given by $$R1'=R1^*\cos\alpha \tag{8}$$

$$R2'=R2^*\cos\beta \tag{9}$$

Thus, using Eqs. (6)-(9), R1 and R2 can be written as $$R1=\{P^*(\delta+d2)\}/\{\cos\alpha^*(d1+d2)\} \tag{10}$$

$$R2=\{P^*(d1-\delta)\}/\{\cos\beta^*(d1+d2)\} \tag{11}$$

Further, since $$R1+R2=P^*[\{(\delta+d2)/\cos\alpha^*(d1+d2)\}+\{(d1-\delta)/\cos\beta^*(d1+d2)\}] \tag{12},$$

Eq. (12) can be written in a simpler form (14) below, in terms of $$K=[\{(\delta+d2)/\cos\alpha^*(d1+d2)\}+\{(d2-\delta)/\cos\beta^*(d1+d2)\}] \tag{13}$$

R1+R2 can be written as $$R1+R2=P^*K \tag{14}$$

Inserting Eq. (14) in Eq. (5), μ1 is determined to be $$\mu1=(\delta/r)/K \tag{15}$$

The magnitude of the frictional force required to develop the self-locking effect is given by (R1+R2)*μ1. Thus, the smaller the μ1 is, the less frictional force is the required for the self-locking.

According to Eq. (15), μ1 can be decreased by either decreasing the eccentric distance δ of the circular eccentric cam 64 or increasing the maximum outer diameter r of the lock plate 68. However, if δ is decreased, the influence of the backlash of the circular eccentric cam 64 on other members such as the lock plate bush 67 becomes significant, which in turn results in an disadvantageous increase in the response time of the self-locking effect. On the other hand, increasing r will make the phase varying mechanism larger and decrease the installation freedom of the mechanism within the engine.

In this embodiment, therefore, in order to prevent, such an adverse effect as discussed above, μ is minimized by increasing the quantity K given by Eq. (15), without changing δ nor r. In fact, K can be increased by setting α and β larger. It is recalled that K is given by $$K=[\{(\delta+d2)/\cos\alpha^*(d1+d2)\}+(d1-\delta)/\cos\beta^*(d1+d2)\}] \tag{13}$$

and α and β for the constituent member 72 are in the range $0°<\alpha<90°$ and $0°<\beta<90°$, so that cos α and cos β are in the range $1>\cos\alpha>0$ and $1>\cos\beta>0$. Accordingly, cos α and cos β can be decreased by setting α and β as large as possible within the respective allowable ranges $0°<\alpha<90°$ and $0°<\beta<90°$. This decreases the denominators of Eq. (13) and increases K.

In short, in the self-locking mechanism 56 of the present embodiment, the self-locking effect can be effected more easily if the angles $\alpha$ and $\beta$ are set larger, and hence the angle $(\alpha+\beta)$ between the abutment protrusions 76 and 77 larger, thereby minimizing $\mu$1. In other words, the self locking effect can be adjusted by adjusting the angles $\alpha$ and $\beta$ in the process of forming the abutment protrusions 76 and 77 on the constituent members 73.

It is noted that if an external disturbing torque is generated in the clockwise direction D1 on the circular eccentric cam 64, the self-locking effect takes place between the abutment protrusions 74 and 75 of the constituent members 73 and the inner periphery 69*a* of the drive cylinder 59. The self-locking effect can be also effected more easily for the constituent member 73 by adjusting the angles between the abutment protrusions 74 and the 75 of the constituent members 73 (these angles correspond to $\alpha$ and $\beta$). Although an external disturbing torque can act on the circular eccentric cam 64 in both directions D1 and D2, the magnitude of the external disturbing torque can depends on its direction. If that is the case, then the frictional torque that appears between the abutment protrusions of the constituent member 72 and the inner periphery 69*a* of the cylinder differ from the torque that appears between the abutment protrusions of the constituent member 73. In the self-locking mechanism 56, it is possible to ensure a self-locking effect irrespective of the direction and magnitude of the frictional torques generated on the constituent members 72 and 73 due to an external disturbing torque inputted in the circular eccentric cam 64. This can be achieved by setting the angle $\alpha+\beta$ between the abutment protrusion 74 and 75 different from the corresponding angle between the abutment protrusions 76 and 77.

Figure 10:
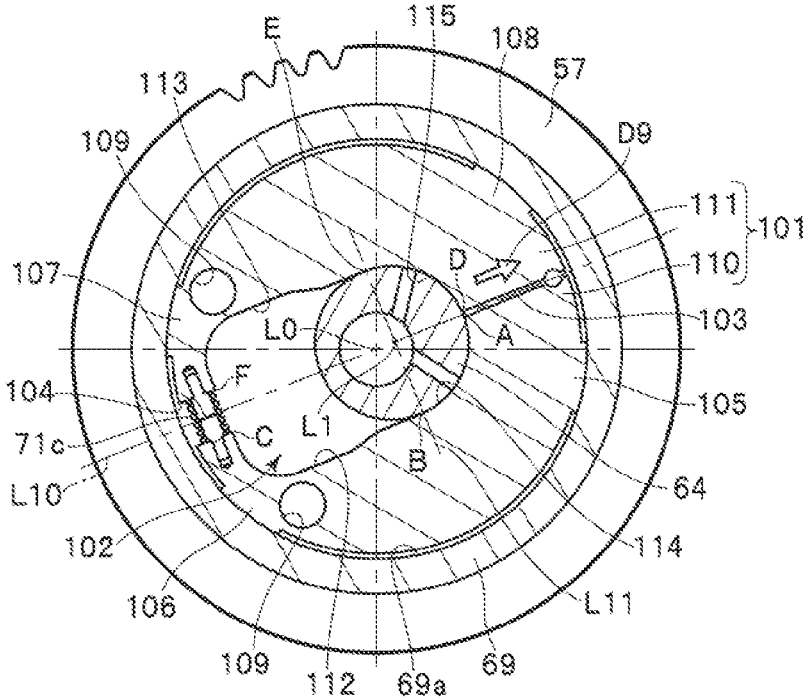
FIG. 10 is a cross section of a first modification of the lock plate, taken along F-F in FIG. 4.

Referring to FIG. 10, a first modification of the lock plate 101 of the self-locking mechanism will now be described. The lock plate 101 has a structure similar to that of the lock plate 68, except that the shapes of a cam holding groove 102 and a slit 103 differ from those of the corresponding cam holding groove 68a and slit. 70, respectively; the length of the abutment protrusions 105-108 differs from that of corresponding abutment protrusions 74-77; and the spacing between paired circular holes 80 is a little wider than that of the corresponding circular holes 109.

The lock plate 101 consists of constituent members 110 and 111 separated by slits 103 and 104, and unlike the lock plate 68, the constituent members 110 and 111 directly hold the circular eccentric cam 64 without any intervening lock plate bush In this self-locking mechanism, manufacture backlashes of the elements are reduced by reducing the number of constituent elements except for the lock plate bush, which facilitates reduction of the response time, and hence improvement of the performance, of the self-locking mechanism. Formed within the constituent members 110 and 111 are inner surfaces 112 and 113 which together serve as the cam holding groove 102. As shown in FIG. 10, the inner surfaces 112 is formed in the region of the constituent members 110 between the end points A and C of the respective slits 103 and 104, while the inner surface 113 is formed in the region of the constituent member 111 between the end points D and F of the respective slits 103 and 104.

Denoting by L10 the line connecting the camshaft axis L0 and the cam center L1 of the circular eccentric cam 64, by L11 the line passing through the can center L1 perpendicularly to the line L10, and by D9 the direction of the eccentricity of the cam center L1 with respect to the camshaft axis L0, it is seen in FIG. 10 that the inner surfaces 112 has an abutment face 114 for holding the circular eccentric cam 64 in contact therewith only in a restricted region between the points A and B offset from the point B in the eccentricity direction D9, where the point B is the intersection of the line L11 and the inner surface 112, while the inner surface 113 has an abutment face 115 for holding the circular eccentric cam 64 in contact therewith only in a restricted region between the point D and point E offset from the point E in the eccentricity direction D9, where the point E is the intersection of the line L11 and the inner surface, 113. The abutment faces 114 and 115 have an arcuate shape extending along the periphery of the circular eccentric cam 64. On the other hand, the regions extending between the point B and point C of the inner surfaces 112 and the region extending between the point E and the point F of the inner surface 113 are both configured to circumvent the periphery of the circular eccentric cam 64 so as not to come into contact with the circular eccentric cam 64.

If the friction between the eccentric cam and the cam holding groove is too large, the external disturbing torque can result in a torque that causes the lock plate to be rotated relative to the cylinder section, whereby impairing the self-locking function of the lock plate. In order to reduce the friction between the circular eccentric cam 64 and the cam holding groove 102, the abutment faces 114 and 115 are formed only in such limited range of the lock plate 101 as offset from the points B and F (which are directly below the cam center L1) in the eccentricity direction D9 so that the circular eccentric cam 64 comes into contact with the cam holding groove 102 only in the limited contact range. Consequently, the self-locking effect infallibly takes place between the inner periphery 69*a* of the cylinder section 69 and the lock plate 101.

It is noted here that the intensity of the self-locking effect can be adjusted by adjusting the friction between the cam holding groove 102 and the circular eccentric cam 64. In order to ensure unlocking of the mechanism in the process of varying the relative phase angle between the center shaft. 61 (or camshaft) and the first control rotor 52 (or crankshaft), the self-locking effect is adjusted in the manner as described below.

The friction between the circular eccentric cam 64 and the abutment faces 114 and 115 is adjusted by adjusting the range and position of the abutment faces 114 and 115 farmed so as to allow the circular eccentric cam 64 come into contact with the cam holding groove 102 within the limited range of the lock plate 101, offset from the points B and F in the eccentricity direction D9 as shown in FIG. 10. For example, in the lock plate 101, the contact range of the abutment faces 114 and 115 can be made narrower as compared with the abutment faces 114 and 115 having the same radius of curvature as the circular eccentric cam 64 by decreasing the radius of curvature of the abutment faces 114 and 115 than that of the circular eccentric cam 64.

The smaller becomes the radius of curvature of the abutment faces 114 and 115, the smaller becomes the contact range of the abutment faces 114 and 115 formed. Accordingly, the friction between the circular eccentric cam 64 and the abutment faces 114 and 115 decreases with the decreasing contact range of the abutment faces 114 and 115, conversely, the friction is enhanced with the contact range of the abutment faces 114 and 115. As the friction decreases, the self-locking effect generated between the cylinder section 69 and the lock plate 101 increases. On the other hand, the self locking mechanism (and hence the self-locking effect) can be released more easily as the contact range is increased to increase the friction.

The intensity of the self-locking effect is adjusted by configuring the abutment faces 114 and 115 in the form of a free-farm surface, for example, rather than arcuate forms, and by limiting the contact range of the abutment faces 114 and 115 in contact with the circular eccentric cam 64 to a predetermined range and position relevant to the abutment faces 114 and 115.

Figure 11:
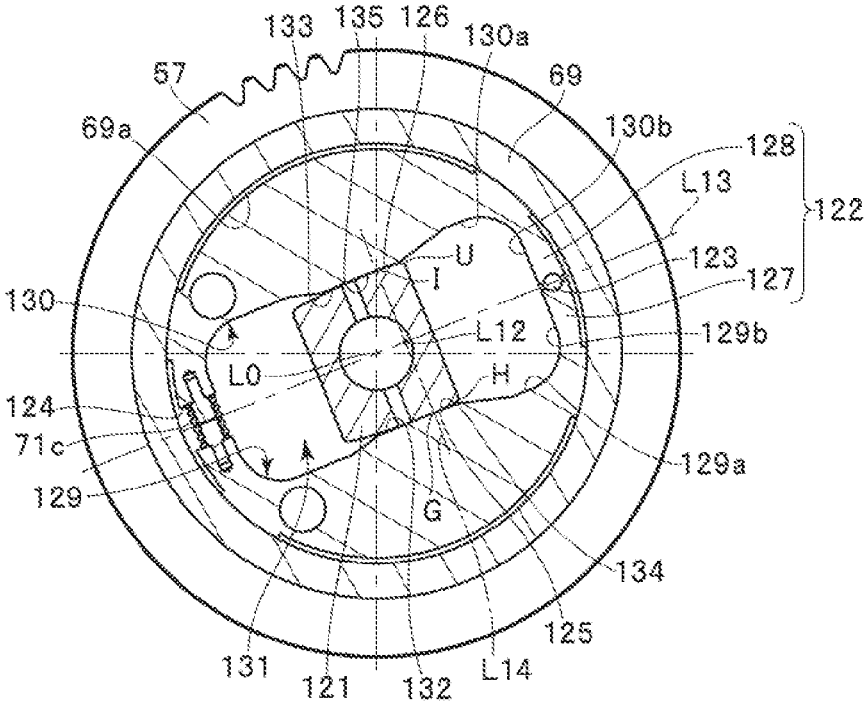
FIG. 11 shows cross sections of the circular eccentric cam and a second modification of the lock plate, taken along F-F in FIG. 4.

Next, referring to FIG. 11, a modification of the circular eccentric cam will now be described, along with a modified lock plate in accordance with a second embodiment. Unlike the circular eccentric cam 64, an eccentric cam 121 has a substantially square shape. The lock plate 122 of the second embodiment is similar in configuration to the lock plate 101, except that the cam holding groove 102 and the slit 123 have different shapes.

The eccentric cam 121 has a cam center L12 offset from the camshaft axis L0 and held-faces 125 and 126 spaced apart across the line L13 that passes through the camshaft axis L0 and the cam center L12. Each of the held-faces 125 and 126 has an arcuate shape protruding in the radially outward direction of the cylinder section 69 with a very large radius of curvature.

On the other hand, the lock plate 122 consists of constituent members 127 and 128 spaced apart across the slits 123 and 124, and having inner surfaces 129 and 130 serving as a cam holding groove 131. The inner surfaces 129 and 130 have long sides 129*a* and 130*a* and short sides 129*b* and 130*b*, which constitute the cam holding groove 131 having four rounded corners. Formed near the center of the long sides 129*a* and 130*a* are stepped cam-holding faces 132 and 133 for holding the held-faces 125 and 126 of the eccentric cam 121.

The cam-holding faces 132 and 133 have an arcuate shape protruding in the radially outward direction of the cylinder section 69 with a radius of curvature smaller than that of the held-faces 125 and 126. An abutment face 134 is formed far slidable contact with the eccentric cam 121 only within a restricted region (of the cam holding face 132) that extends in the eccentricity direction D10 from the intersection G of the cam holding face 132 and the line L14 crossing the L13 at a right angle at the cam center L12 to the corner H proximal to the slit 123. An abutment face 135 is formed far slidable contact with the eccentric cam 121 only within a restricted region (of the cam holding face 133) that extends in the eccentricity direction D10 from the intersection of the lock plate 14 and the cam holding face 133 to the corner J proximal to the slit 123. The eccentric cam 121 is held on the abutment faces 134 and 135 with its held-faces 125 and 126 kept in contact with the abutment faces 134 and 135. It is noted that the portion of the cam holding groove 131 other than the abutment faces 134 and 135 will not come into contact with the eccentric cam 64.

Compared with the circular eccentric cam 64, such a generally square eccentric cam as the eccentric cam 121 can have a longer eccentric distance without increasing the length of the cam, so that use of the eccentric cam adds more degrees of freedom in the determination of cam length.

In forming the cam-holding faces 132 and 133, the self-locking effect can be enhanced by decreasing the radius of curvature, and narrowing the width, of the abutment faces 134 and 135. On the other hand, the self-locking function becomes easily releasable by increasing the range of the abutment faces 134 and 135. The intensity of the self-locking effect can be adjusted by providing the cam-holding faces 132 and 133 in a linear form or a free-form, instead of an arc, and by restricting the contact point between the abutment faces 134 and 135 and the held-faces 125 and 126 within a predetermined limited range of the lock plate, offset from the line L13 in the eccentricity direction D10 in accord with the configuration of the abutment faces 134 and 135.

DESCRIPTION OF SYMBOLS

50 phase varying apparatus for an automobile engine
51 drive rotor
52 first control rotor (Control rotor of claim 1)
53 torque provision means
54 phase angle varying mechanism
56 self-locking mechanism
57 sprocket
59 drive cylinder
64 and 121 (circular) eccentric cam
68 lock plate
68*a*, 102, and 131 cam holding grooves
69 cylinder section
69*a* inner periphery of the cylinder section
70 and 71 slits
71*c* compression coil spring (urging means of claim 3)
74-77 abutment protrusions of lock plate
L0 camshaft axis
L1 and L12 cam centers of (circular) eccentric cams.
L2, L10, and L13 lines passing through the camshaft axis and cam centers
L3, L11, and L14 lines crossing lines L2, L10, and L13 at right angles
D9 and D10 direction of eccentricity

The invention claimed is:

1. A phase varying apparatus having:
a drive rotor driven by the crankshaft of the engine,
a control rotor,
a camshaft for rotatably and coaxially supporting the drive rotor,
a torque provision means for providing the control rotor with a torque to rotate the control rotor relative to the drive rotor,
a phase angle varying mechanism for varying the relative phase angle between the camshaft and the drive rotor in response to the rotation of the control rotor relative to the drive rotor, and
a self-locking mechanism for preventing a gap in phase angle due town external disturbing cam torque from occurring between the drive rotor and the camshaft,
the phase angle varying apparatus characterized in that the self-locking mechanism comprises:
a cylinder section mounted on the drive rotor;
a circular eccentric can integral with the camshaft; and
a lock plate having a can holding groove for holding therein the circular eccentric cam, and
the lock plate is provided on the periphery thereof with at least four radial abutment protrusions in smooth contact with the inner circumference of the cylinder section.

2. A phase varying apparatus having
a drive rotor driven by the crankshaft of the engine,
a control rotor,
a camshaft for rotatably and coaxially supporting the drive rotor,
a torque provision means for providing the control rotor with a torque to rotate the control rotor relative to the drive rotor,
a phase angle varying mechanism for varying the relative phase angle between the camshaft and the drive rotor in response to the rotation of the control rotor relative to the drive rotor, and a self-locking mechanism for preventing a gap in phase angle due to an external disturbing cam torque from occurring between the drive rotor and the camshaft due to an undesirable cam torque, the phase angle varying apparatus characterized in that the self-locking mechanism comprises:

a cylinder section mounted on the drive rotor;

a circular eccentric cam integral with the camshaft; and a lock plate having a cam holding groove formed therein support the eccentric cam, the cam holding groove having an abutment faces in abutting contact with the periphery of the circular eccentric cam to hold said circular eccentric cam, with the abutment faces formed only in the restricted region of the lock plate offset from the line passing through the cam center perpendicularly in the eccentricity direction of the cam, where the eccentricity direction is defined to be the direction of the half line that extends from the camshaft axis towards the cam center of the eccentric cam.

3. The phase varying apparatus according to claim 1 or 2, wherein the lock plate is divided into two sections by a pair of radial slits that extend from the cam holding groove to the periphery of the lock plate, with one slit provided with a means for widening the slit.

4. The phase varying apparatus according to claim 3, wherein the drive rotor has a sprocket which is integral with the cylinder section and driven by the crankshaft, with the lock plate arranged at a predetermined axial position between the cylinder section and the sprocket.

* * * * *